United States Patent [19]

Neuenschwander

[11] Patent Number: 4,473,160

[45] Date of Patent: Sep. 25, 1984

[54] APPARATUS FOR LOWERING ARTICLES FROM A BUILDING

[76] Inventor: Robert J. Neuenschwander, R.R. #1, Box 96B, Hibbing, Minn. 55746

[21] Appl. No.: 341,533

[22] Filed: Jan. 21, 1982

[51] Int. Cl.[3] ..... B66C 11/16

[52] U.S. Cl. ..... 212/116; 212/225; 182/37

[58] Field of Search ..... 212/116, 194, 233, 83, 212/97; 188/293, 294; 242/100.2; 254/279-281, 283-286; 182/36-38, 70, 74, 75, 142, 236, 238, 239; 187/15, 27, 95

[56] References Cited

U.S. PATENT DOCUMENTS

| | | | |
|---|---|---|---|
| 257,128 | 4/1882 | Beckert | 212/83 |
| 374,596 | 12/1887 | Gray et al. | 182/6 |
| 415,867 | 11/1889 | Hill | 182/6 |
| 484,536 | 10/1892 | Leber | 182/6 |
| 728,145 | 5/1903 | Triplett | 182/238 |
| 767,652 | 8/1904 | Motherwell | 212/116 |
| 858,814 | 7/1907 | MacKaskie | 212/83 |
| 955,940 | 4/1910 | Bowcher | 212/83 |
| 1,099,834 | 6/1914 | Baldwin et al. | 182/238 |
| 1,631,800 | 6/1927 | Dotsch | 188/293 |
| 2,504,206 | 4/1950 | Kunzelman | 187/27 |
| 2,553,090 | 5/1951 | Holley | 254/160 |
| 2,703,219 | 3/1955 | Henshaw | 254/158 |
| 2,998,094 | 8/1961 | Fisher | 182/142 |
| 3,159,110 | 12/1964 | Wylie | 182/36 |
| 3,844,377 | 10/1974 | Wilkins | 182/6 |
| 4,018,423 | 4/1977 | Belew | 254/158 |

FOREIGN PATENT DOCUMENTS

| | | | |
|---|---|---|---|
| 1964564 | 2/1971 | Fed. Rep. of Germany | 188/293 |

*Primary Examiner*—Trygve M. Blix
*Assistant Examiner*—Rodney Corl
*Attorney, Agent, or Firm*—Wicks & Nemer

[57] ABSTRACT

An apparatus for lowering articles from a building including a tower having a boom extending therefrom. A transfer carriage is slideably mounted on the boom and has a latching mechanism for engagement with an end plate on the boom. The carriage also has a mechanism for engaging a cage as the cage is raised by a cable to the carriage and disengaging the cage when the cage reaches the outer end of the boom. A cable mechanism in cooperation with powered drum members lowers and raises the cage while alternately raising and lowering a second cage which is on a boom with a transfer carriage identical to the first mentioned boom and transfer carriage. The rate of movement of the cable and therefore the rate of travel of the cages is controlled by a hydraulic motor connected to a closed loop conduit, the conduit having an orifice preset to regulate the flow of oil to and from the motor which in turn regulates the speed of the cable drums.

17 Claims, 11 Drawing Figures

APPARATUS FOR LOWERING ARTICLES FROM A BUILDING

SUMMARY

The invention relates to an improvement in an apparatus for lowering articles from a building and more particularly to an apparatus mounted adjacent the edge of a building either on top of the building or at an opening at any floor of a building and having a cage which accommodates people whereby the cage may be lowered from a departure point to the ground and returned to the departure point in conjunction with an identical second cage alternating lowering and raising relative to the first cage.

It is an object of the invention to provide a lowering apparatus having a first cage releasably connected to a transfer carriage slideably mounted on a boom extending from a tower member. The cage is caused to slide to the outer end of the boom where it is automatically engaged and the cage is automatically lowered by cable mechanism and a second cage is simultaneously raised with identical construction. As a cage is raised to the end of a boom, it is automatically engaged with the transfer carriage and the transfer carriage is automatically disengaged from the end of the boom and drawn inwardly to the departure point. The cable mechanism includes a hydraulic motor with a loop conduit and orifice construction which controls the speed of travel of the cable.

The invention will appear more clearly from the following detailed description when taken in connection with the accompanying drawings, showing by way of example a preferred embodiment of the inventive idea wherein like numerals refer to like parts throughout.

In the drawings forming part of this application:

Figure 1:
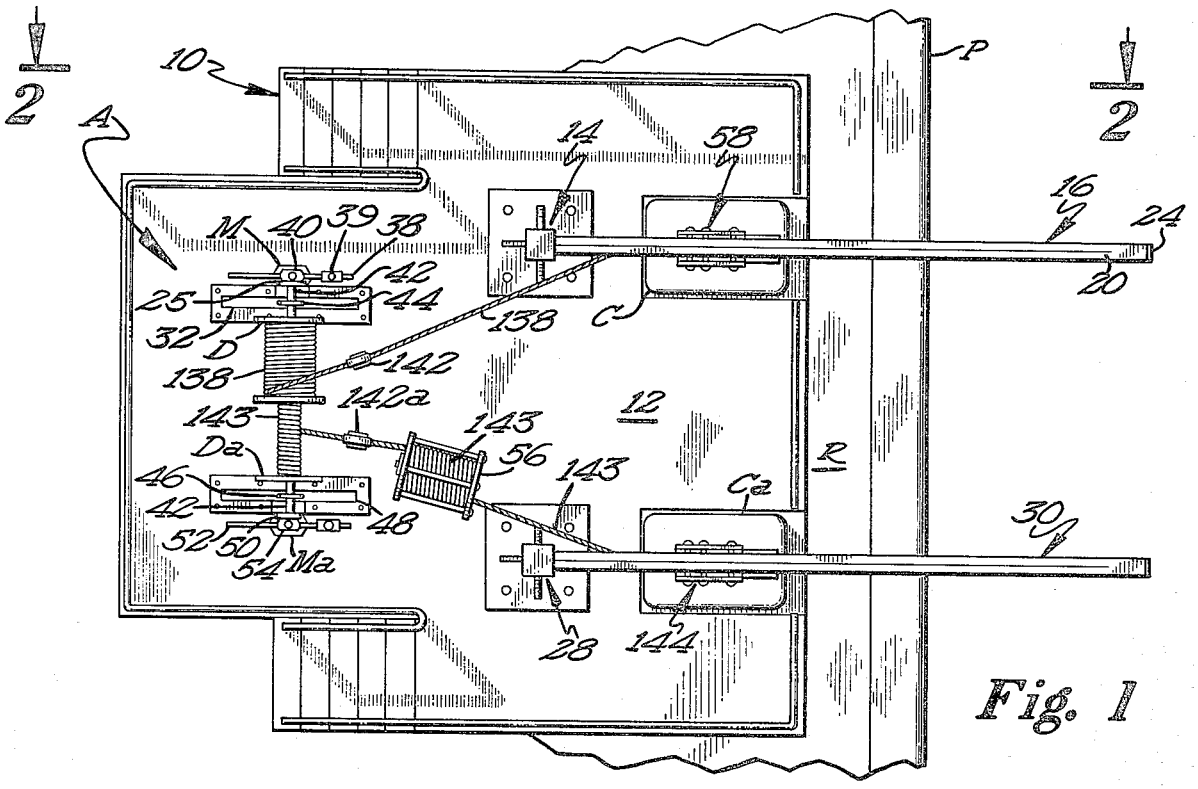
FIG. 1 is a top plan view of a lowering apparatus for a building embodying the invention.

Referring to the drawings in detail, the lowering apparatus A includes the base 10 which has the platform 12, the base is shown as mounted on the roof R of a building adjacent the parapet P thereof. Securedly mounted on the platform 12 is a vertical support member in one form of the first tower 14 and secured to and extending from the tower is the first boom 16. The boom 16 is formed from an I beam with the central member 18 having the upper flange 20 and the lower flange 22 thereof. Formed on the outer end of the boom is the right angular depending end plate 24. A truss support 26 reinforces the connection of the boom to the tower 14. The boom 16 slopes downwardly from the tower 14 outwardly.

The numeral 28 designates a second tower and secured to and extending from the tower is a second boom 30 identical to boom 16 having an end plate identical to boom end plate 24. Further provided is a first conventional hydraulic gear pump M specifically Webster Gear Pump #HP-1 mounted on the plate 25 connected to the cross support 32 supported by the legs 34 and 36 secured to the platform 12. A tubular closed loop conduit 38 is connected to each side of the hydraulic pump M with an adjustable orifice 40 at the top center of the loop, the orifice being preset for regulation of the oil flow to and from the hydraulic pump via the conduit which in turn regulates the speed of the drums which feeds cable off the drums to the holding mechanism 58 which holds an article such as the cage C while personnel or material is being loaded. In the preferred embodiment, orifice 40 comprises a needle valve including a tamper proof adjustment key and a locknut for preventing unwanted changes in flow and particularly is a needle valve sold under the trademark "PNEU-TROL" by Deltrol Fluid Products. Also in the preferred embodiment, conduit 38 includes an inlet 39 shown in its preferred form as a T connector in conduit 38 for allowing the introduction of hydraulic fluid into conduit 38. The pump M is connected to one end of the shaft 42 of the drum D, with the shaft mounted in the bearing 44 secured to the cross support 32. The shaft 42 also mounts the second cable drum Da, and the shaft is mounted in the bearing 46 on the cross support 48 mounted on legs identical to legs 34 and 36 of cross support 32. A second hydraulic-pump Ma is secured to plate 50 connected to cross support 48. A tubular closed loop conduit 52 is connected to each side of the conventional hydraulic gear pump Ma with an adjustable orifice 54 identical to orifice 40 at the top center of the loop as in the case of pump M. The motor Ma is connected to the other end of the shaft 42. The numeral 56 designates a cable storage drum mounted on the platform 12 adjacent the drum D and at an angle thereto substantially as shown in FIG. 1.

Further provided is a first holding mechanism in one form of the transfer carriage 58 which includes the spaced sidewalls 60 and 62. Rotatably mounted on the inside of the wall 60 are the spaced rollers 64 and 66 and likewise the spaced rollers 68 and 70 are rotatably mounted on the inside of the wall 62. Secured to the front lower edge of the wall 60 is the extension 72 and secured to the front lower edge of the wall 62 is the extension 74. The cross bar 76 connects with the extensions 72 and 74 and has secured centrally thereto and depending therefrom the eye bolt 78. The sidewalls 60 and 62 are connected by the partial rear wall 80 through which is formed the hole 82 and the partial bottom cross bar 83.

Secured to and extending horizontally from the boom end plate 24 is the means for disengaging the releasable engageable members hereinafter mentioned, including extension 84 with the upstanding latch hook 86 at the inner end thereof. At the hook end the extension is tapered to a rounded point as at 85 and an arcuate cam surface 87. An intermediate bottom bar 88 is connected to and spans the bottom of the sidewalls 60 and 62. Additionally provided is the support 90 secured to and extending inwardly of the wall 62, and threadedly mounted thereon for adjustment is the cap screw 92 which has positioned thereon the coil spring 94 for pressure engagement with the latch arm 96 having the hook end 98. The hook end 98 is also formed with the arcuate cam end surface 99. The latch arm 96 is pivotally mounted at one end on the pin 100 secured to and extending to and between the walls 60 and 62.

The numeral 102 designates a first latch jaw pivotally mounted at one end on the intermediate bottom bar 88 by means of the pin 104. A second latch jaw 106 identical to jaw 102 is pivotally mounted on one end on the intermediate bottom bar 88 by means of the pin 108, and each jaw is formed with an arcuate cam surface 110. Further provided is the pulley 112 mounted on the shaft 114 connected to an extending between the walls 60 and 62. The pulley is mounted in alignment with the hole 82 in the rear wall 80. The jaws 102 and 106 are urged toward each other by the coil spring 109 connected to the ears 111 and 113 on the arms, respectively.

Figure 2:
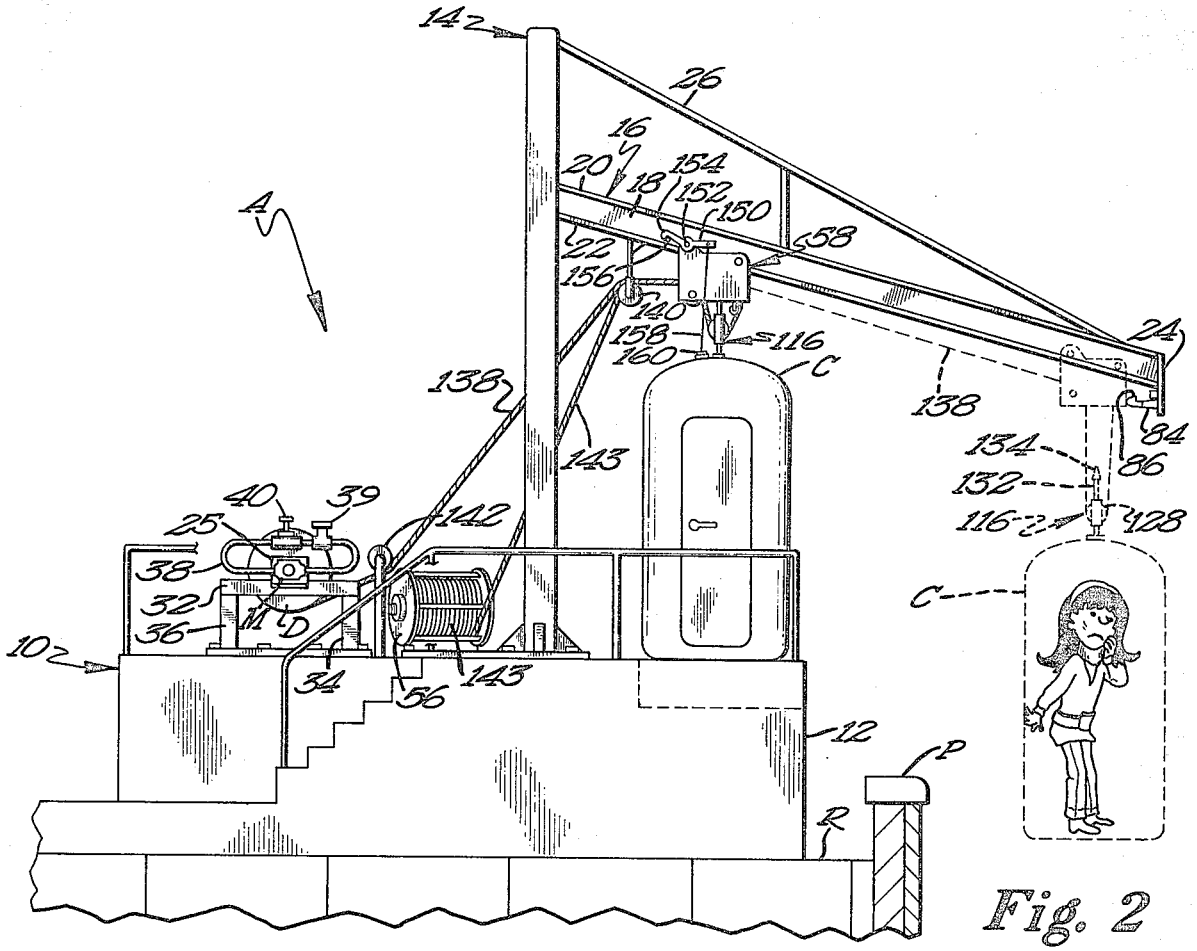
FIG. 2 is a side elevational view of the apparatus from the line 2—2 of FIG. 1.
Figure 3:
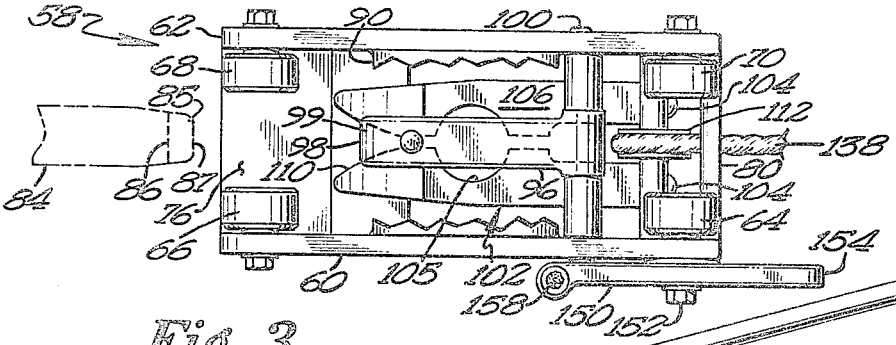
FIG. 3 is a top plan view of the hoist direction transfer carriage.
Figure 11:
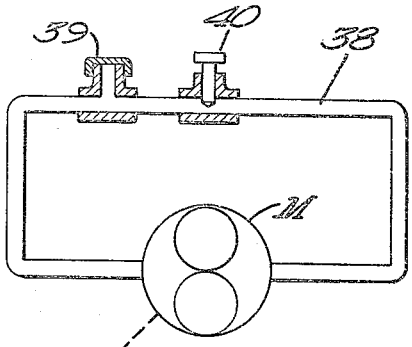
FIG. 11 is a diagrammatic view of the control mechanism for the cable drum.
Figure 11:
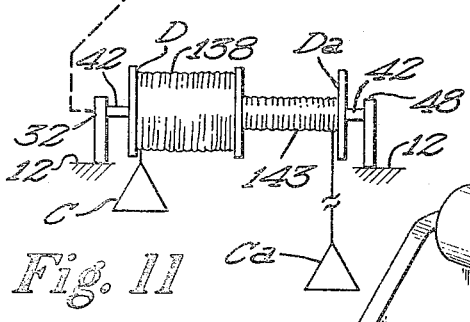

The numeral 116 designates a latch jaw actuator which includes the spaced side plates 118 and 120 connected at the top by the top bar 122 and at the bottom by the bottom bar 124. A pin 126 is mounted centrally of and extending through the side plates 118 and 120 and on which the pulley 128 is mounted. Secured to the bottom bar 124 is the eye bolt 130 and secured to and extending upwardly from the top bar 122 is the rod 132. Mounted on the top end of the rod 132 is the conical latch jaws actuator 134. The latch jaw actuator 116 is secured to the top of the cage C shown in phantom in FIG. 2.

As mentioned heretofore, the second tower 28 is identical to the first tower 14, and the boom 30 is identical to boom 16, and additionally, the second transfer carriage 144 is identical to first transfer carriage 58.

With reference to tower 14 and boom 16, a first cable 138 is connected to the eye bolt 78 of the first transfer carriage 58 and passed over the pulley 128 of the latch jaw actuator 116. The cable is then extended upwardly and over the pulley 112 inside the transfer carriage 58 and from pulley 112 over pulley 140 mounted in the underside of the boom 16 and thence to the pulley 142 mounted on the platform 12 from which it is extended to and wound upon the drum D fully with the cage C in raised position on the boom 16, particularly FIG. 1.

A second cable 143 is substantially fully wound on storage drum 56 and extended at one end of the drum to drum Da where it is only partially wound thereon. The other portion of cable 143 is extended to a pulley identical to pulley 140 on boom 16 and thence to the second transfer carriage 144 identical to first transfer carriage 58 from which is extended downwardly to the second cage Ca all in the same manner as in FIG. 2. with regard to cage C and transfer carriage 58.

Cable 138 is wound on drum D oppositely to the winding of cable 143 upon drum Da so that as cable 138 is released off drum D, for example, as shaft 42 is rotated, cable 143 is wound to and upon drum Da. The rollers 64, 66, 68 and 70 engage the flange 22 on each side of the central member 18 of the boom 16. Further provided is the latching arm 150 pivotally mounted on the pin 152 secured on the transfer carriage 58, FIG. 2. The arm 150 has the hook 154 formed thereon which releasably engages the pin 156 extended from the central member 18 of the boom 16. A small cable 158 is attached to the end of the arm 150 and extended downwardly through the opening 160 formed in the top wall of the cage C.

With the latching arm hook 154 engaged with the pin 156 the cage C is held from rolling out on the boom. The cage C is released by a party in the cage pulling on the cable 158. Identical latch mechanism is provided for cage Ca.

OPERATION

Figure 4:
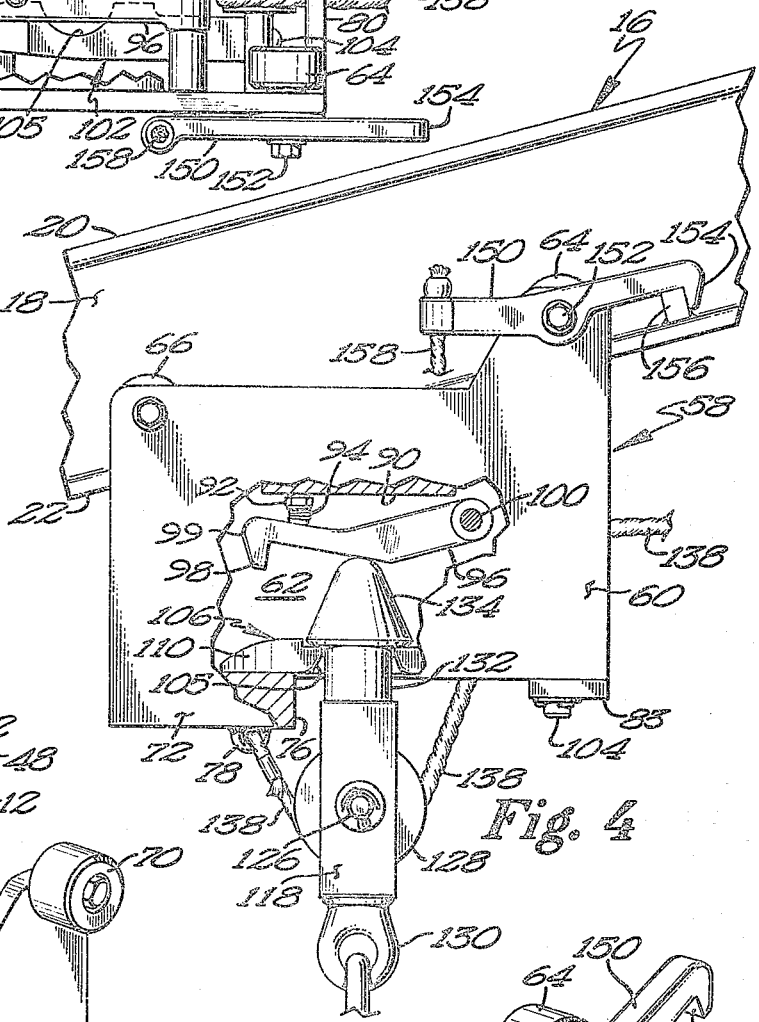
FIG. 4 is a side elevational view of the transfer carriage of FIG. 3 on a boom of the apparatus of FIG. 1 showing the disengagement of the transfer carriage from the boom end plate, with portions of the transfer carriage being broken away.
Figure 5:
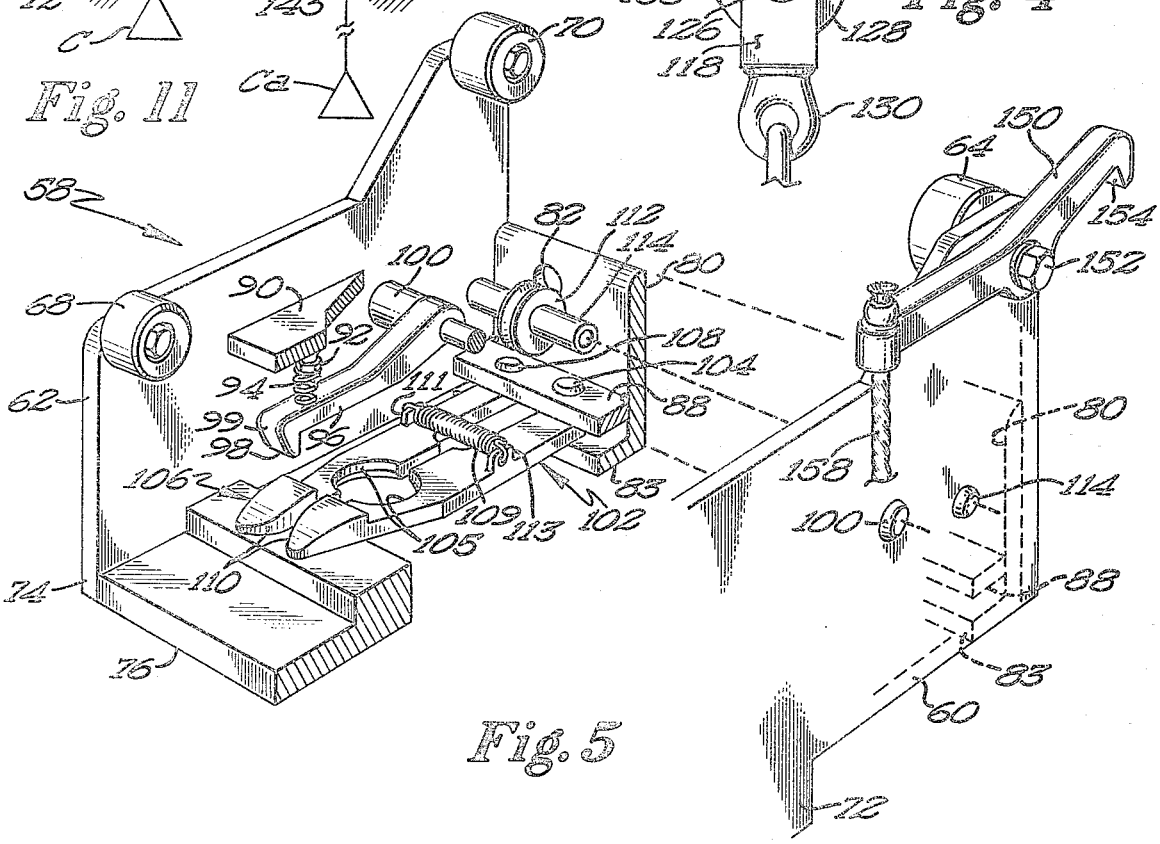
FIG. 5 is an exploded perspective view of the transfer carriage.
Figure 8:
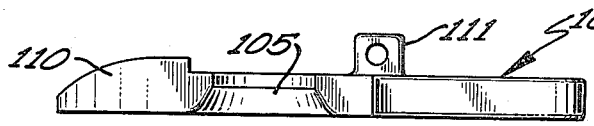
FIG. 8 is a longitudinal side view of a latch jaw of the transfer carriage taken along the line 8—8 of FIG. 7.
Figure 6:
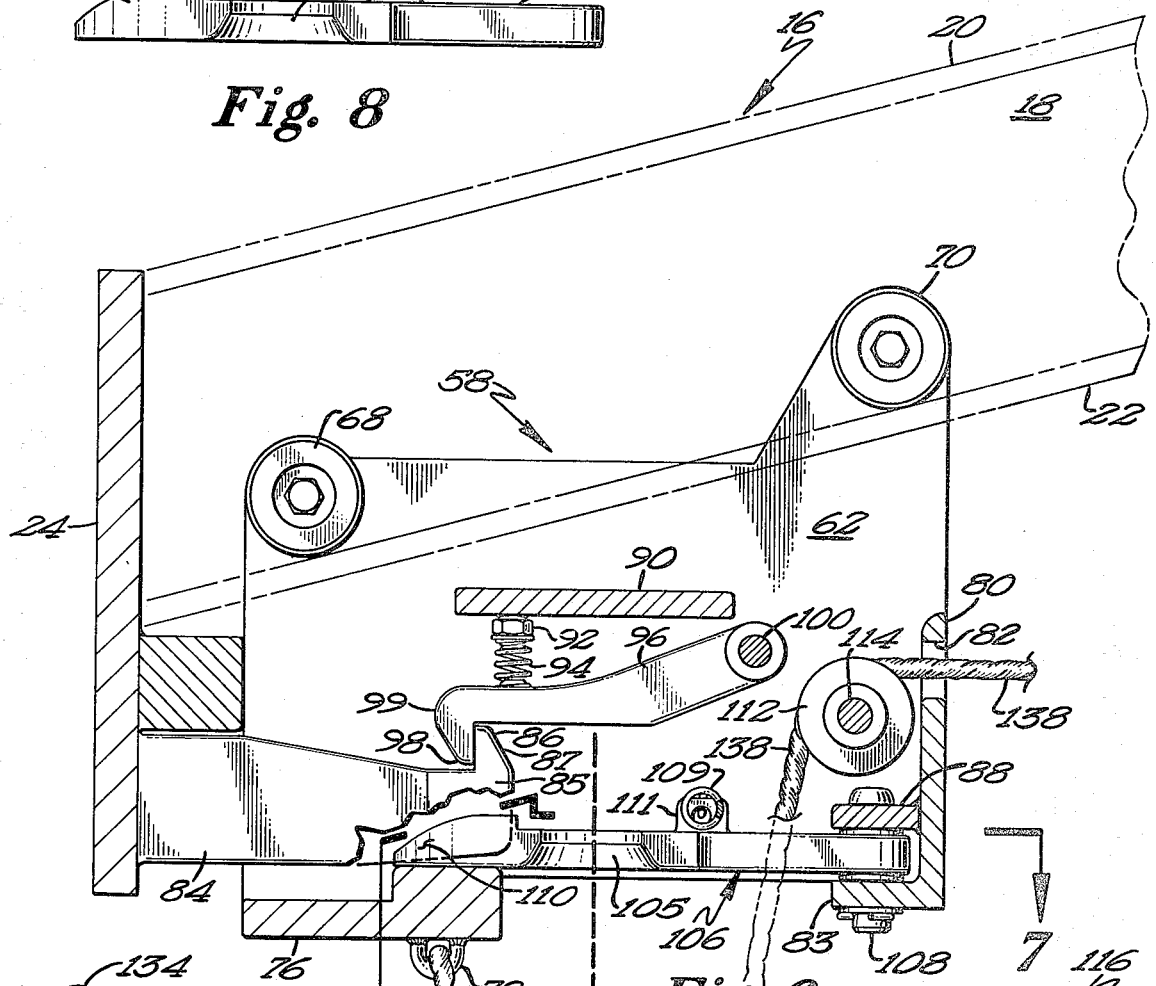
FIG. 6 is a view similar to that of FIG. 4. showing engagement of the transfer carriage to the extention of the boom end plate.
Figure 9:
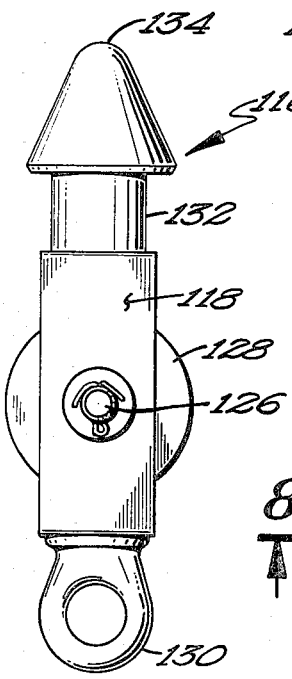
FIG. 9 is a side elevational view of the latch jaw actuator.
Figure 7:
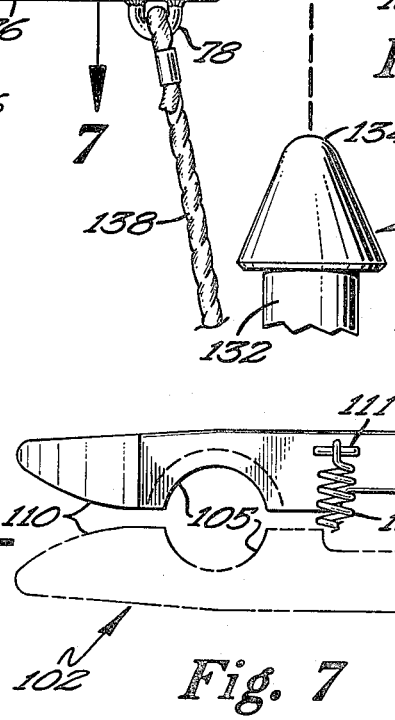
FIG. 7 is a top plan view of a latch jaw of the transfer carriage taken along line 7—7 of FIG. 6.
Figure 10:
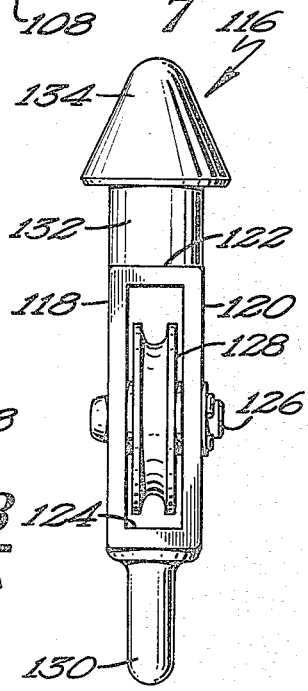
FIG. 10 is an end view of the latch jaw actuator.

In the operation of the lowering apparatus A, let it be assumed that both cages C and Ca are in a first article position up and upon the platform as in FIGS. 1. and 2. with cable 138 fully wound onto drum D. Prior to allowing the cage C to roll out to its second article position located at the end of the boom, the conical latch 134 is forced up against the tapered and circular opening 105 formed on each of the arms 102 and 106, thus separating the arms and engaging the base of the latch 134 upon the arms 102 and 106 urged together which holds the cage C to the carriage 58 and with the arm 96 raised as in FIG. 4. Also, latch arm 150 is engaged to hold the cage against the tendency to roll outwardly on the boom. The latch arm 150 is then released by cable 158 actuated by a person in the cage. As the hydraulic motors M and Ma rotate, the drums D and Da, cable 138 is paid off from drum D and the cage C rolls outwardly on the boom because of gravity due to the down ward slope of the boom 16. As the transfer carriage 58 gets to the outer end of the boom 16, the tapered end 85 of the extension 84 is contacted and it forces the jaws 102 and 106 apart, and the conical latch actuator 134 is released from the jaws 102 and 106 thereby freeing the cage from the transfer carriage 58 and allowed to lower by the releasing of the cable 138 off drum D and over the pulleys 142, 140 and 112. With the cage C released from the carriage, the latch arm 96 engages the hook 86 whereby the carriage is releasably connected to the boom end plate 24.

When cage C reaches its third article or its lowermost lowered position, the cage Ca is lowered with added weight in the same manner as cage C and cable 143 drawn off the supply drum 56 and then when all cable is off drum 56 directly from the transfer carriage 144 of boom 30 due to the fact that the drum Da rotates oppositely to that of drum D as previously stated. For one cage traveling downwardly to raise the other cage, the lowering cage must carry weight greater than the raising cage. As to the cage Ca, the parts of the carriage 144 are identical to those of carriage 58 and so described here for the operation of carriage 144. The conical latch 134 is forced between the latch arms 102 and 106 thus separating the arms whereby the base of the conical latch contacts upon the top of the latch arms as the same are urged upon the rod 132 as in FIG. 4. Simultaneously, the arm 96 is moved into the raised and unlatched condition, FIG. 4., whereby upon further drawing upon the cable 138, the carriage 144 and cage Ca held beneath is pulled along the boom 30 to a point upon the platform 12 adjacent the post 14. At the same time, the cage C has lowered as described.

Having thus described the invention, what is claimed as new and desired to be secured by Letters Patent is:

1. An apparatus for moving an article between a first article position, a second article position, and a third article position, with the second article position being at generally the same vertical location but horizontally over from the first article position and with the third article position being at generally the same horizontal location but vertically below the second article position, comprising, in combination: a track having a first end and a second end; a transfer carriage moveable on the track between a first carriage position located adjacent the first end of the track and a second carriage position located adjacent the second end of the track; a cable having a first end and a second end; pulley means operatively attached to the transfer carriage, with the first end of the cable being operatively attached to the article and around the pulley means operatively attached to the transfer carriage; releasable article locking means for attaching the article to the transfer carriage when the transfer carriage is located in any position other than its second carriage position and for releasing the article when the transfer carriage is moved into its second transfer carriage position from its first transfer carriage position comprising, in combination: an actuator attached to the article; latch means attached to the transfer carriage having a first normal actuator engaging position for holding the actuator relative to the latch means and a second position which does not engage with the actuator; and means attached adjacent to the second end of the track for moving the latch means to its second latch position when the transfer carriage is in its second transfer carriage position; releasable transfer carriage locking means for locking the transfer carriage to its second position when the article is between its second article position and its third article position and for releasing the transfer carriage when the article is moved into its second article position from its third article position comprising, in combination: a first lock member attached adjacent to the second end of the track, a second lock member attached to the transfer carriage having a first normal locking position in locking engagement with the first lock member and a second, open position which does not engage with the first lock member; and means attached to the article for moving the second lock member from its first locking position to its second open position when the article is in or between its first and second article positions; and means for releasing the second end of the cable allowing the movement of the article from its first article position, through its second article position, and to its third article position and for pulling the second end of the cable allowing the movement of the article from its third article position, through its second article position, and to its first article position, wherein the latch means comprises, in combination: a first latch jaw having a first end pivotally attached to the transfer carriage and having a second end; a second latch jaw having a first end pivotally attached to the transfer carriage and having a second end with the second latch jaw being generally parallel to the first latch jaw; means for biasing the first and second latch jaws together; and wherein the actuator comprises, in combination: a camming surface for engaging with and separating the first and second latch jaws; and an abutting edge for resting on the first and second jaws after the camming surface passes through the first and second jaws.

2. The apparatus of claim 1 wherein the latch moving means and the first lock member are formed on the same member.

3. The apparatus of claim 1 wherein the actuator and the second lock member moving means are formed on the same member.

4. The apparatus of claim 1 wherein the first and second latch jaws include a camming surface complementary to and for engagement with the camming surface of the actuator.

5. The apparatus of claim 1 wherein the second lock member moving means comprises an abutment end formed on the actuator.

6. The apparatus of claim 5 wherein the abutment end, the camming surface, and the abutting edge forms a cone.

7. The apparatus of claim 1 or 6 wherein the first lock member comprises, in combination: an extension attached to the track including an upstanding latch hook having an arcuate cam surface; wherein the second lock member comprises, in combination: a latch arm pivotally attached to the transfer carriage including a hook end having an arcuate cam end for camming upon the cam surface of the extension; and means for downwardly biasing the latch arm.

8. The apparatus of claim 1 wherein the cable releasing and pulling means comprises, in combination: a drum mounted for rotation, with the second end of the cable attached to the drum; and means for rotating the drum.

9. The apparatus of claim 1 wherein the second end of the track is slightly vertically below the first end of the track to assist the movement of the transfer carriage from its first carriage position to its second carriage position by the force of gravity.

10. Apparatus for lowering articles from the roof of a building to the ground comprising, in combination: a first generally horizontal track extending from an interior point of the roof to a point past the side of the roof and having a first end and a second end; a second generally horizontal track extending from an interior point of the roof to a point past the side of the roof and having a first end and a second end; a first transfer carriage moveable on the first track between a first carriage position located adjacent the first end of the track and a second carriage position located adjacent the second end of the track; a second transfer carriage moveable on the second track between a first carriage position located adjacent the first end of the track and a second carriage position located adjacent the second end of the track; a first cable having a first end and a second end; a second cable having a first end and a second end; with the first and second transfer carriages including pulley means for directing cable; with the first end of the cable being operatively attached to an article and extending around the pulley means of the first transfer carriage, with the first end of the second cable being operatively attached to another article and extending around the first pulley means of the second transfer carriage; first releasable article locking means for attaching the article to the first transfer carriage when the transfer carriage is located in any position other than its second carriage position and for releasing the article when the transfer carriage is moved into its second transfer carriage position from its first transfer carriage position; second releasable article locking means for attaching the other article to the second transfer carriage when the transfer carriage is located in any position other than its second carriage position and for releasing the article when the transfer carriage is moved into its second transfer carriage position from its first transfer carriage position; first releasable transfer carriage locking means for locking the transfer carriage in its second position when the article is released from the transfer carriage and for releasing the transfer carriage from its second position when the article is locked in the transfer carriage; second releasable transfer carriage locking means for locking the transfer carriage in its second position when the article is released from the transfer carriage and for releasing the transfer carriage from its second position when the article is locked in the transfer carriage; a rotatable drum having a first drum portion and a second drum portion, with the second end of the first cable being attached to the first drum portion in a first wind direction and with the second end of the second cable being attached to the second drum portion in a second wind direction which is opposite to the first wind direction, with one of the first cable or the second cable being wound on the drum and the other of the first cable or the second cable being unwound from the drum so that as the wound cable unwinds, the unwound cable will wind up on the drum, and means for regulating the rotation of the drum which in turn regulates the unwinding and winding of the first and second cables on the drum comprising, in combination: a hydraulic gear pump in a rotatable relation with the drum, with pump having a hydraulic inlet and a hydraulic outlet; a closed loop hydraulic conduit extending between the hydraulic inlet and the hydraulic outlet; and means in the hydraulic conduit for creating back-pressure in the hydraulic gear pump for creating reverse torque on the drum.

11. The apparatus of claim 10 wherein the back-pressure creating means comprises, in combination: an adjustable orifice formed in the hydraulic conduit.

12. The apparatus of claim 10 further comprising, in combination: a cable storage spool, with the cable which is unwound from the drum being wound intermediate its first and second ends on the cable storage spool so that initially both articles can be located on the roof of the building.

13. The apparatus of claim 10 wherein the first and second article locking means comprises in combination; an actuator attached to the article; latch means attached to the transfer carriage having a first normal actuator engaging position for holding the actuator relative to the latch means and a second position which does not engage with the actuator; and means attached adjacent to the second end of the track for moving the latch means to its second latch position when the transfer carriage is in its second transfer carriage position.

14. The apparatus of claim 13 wherein the first and second transfer carriage locking means comprises, in combination: a first lock member attached adjacent to the second end of the track, a second lock member attached to the transfer carriage having a first normal locking position in locking engagement with the first lock member and a second open position which does not engage with the first lock member; and means attached to the article for moving the second lock member from its first locking position to its second open position when the article is locked in the transfer carriage.

15. Apparatus for lowering articles from the roof of a building to the ground comprising, in combination: a first generally horizontal track extending from an interior point of the roof to a point past the side of the roof and having a first end and a second end; a second generally horizontal track extending from an interior point of the roof to a point past the side of the roof and having a first end and a second end; a first transfer carriage moveable on the first track between a first carriage position located adjacent the first end of the track and a second carriage position located adjacent the second end of the track; a second transfer carriage moveable on the second track between a first carriage position located adjacent the first end of the track and a second carriage position located adjacent the second end of the track; a first cable having a first end and a second end; a second cable having a first end and a second end; with the first and second transfer carriages including pulley means for directing cable; with the first end of the first cable being operatively attached to an article and extending around the pulley means of the first transfer carriage, with the first end of the second cable being operatively attached to another article and extending around the first pulley means of the second transfer carriage; first releasable article locking means for attaching the article to the first transfer carriage when the transfer carriage is located in any position other than its second carriage position and for releasing the article when the transfer carriage is moved into its second transfer carriage position from its first transfer carriage position; second releasable article locking means for attaching the other article to the second transfer carriage when the transfer carriage is located in any position other than its second carriage position and for releasing the article when the transfer carriage is moved into its second transfer carriage position from its first transfer carriage position; first releasable transfer carriage locking means for locking the transfer carriage in its second position when the article is released from the transfer carriage and for releasing the transfer carriage from its second position when the article is locked in the transfer carriage; second releasable transfer carriage locking means for locking the transfer carriage in its second position when the article is released from the transfer carriage and for releasing the transfer carriage from its second position when the article is locked in the transfer carriage; a rotatable drum having a first drum portion and a second drum portion, with the second end of the first cable being attached to the first drum portion in a first wind direction and with the second end of the second cable being attached to the second drum portion in a second wind direction which is opposite to the first wind direction, with one of the first cable or the second cable being wound on the drum and the other of the first cable or the second cable being unwound from the drum so that as the wound cable unwinds, the unwound cable will wind up on the drum; and means for regulating the rotation of the drum which in turn regulates the unwinding and winding of the first and second cables on the drum, wherein the first and second article locking means comprises, in combination: an actuator attached to the article; latch means attached to the transfer carriage having a first normal actuator engaging position for holding the actuator relative to the latch means and a second position which does not engage with the actuator; and means attached adjacent to the second end of the track for moving the latch means to its second latch position when the transfer carriage is in its second transfer carriage position, wherein the first and second transfer carriage locking means comprises, in combination: a first lock member attached adjacent to the second end of the track, a second lock member attached to the transfer carriage having a first normal locking position in locking engagement with the first lock member and a second open position which does not engage with the first lock member; and means attached to the article for moving the second lock member from its first locking position to its second open position when the article is locked in the transfer carriage, and wherein the latch means comprises, in combination: a first latch jaw having a first end pivotally attached to the transfer carriage and having a second end; a second latch jaw having a first end pivotally attached to the transfer carriage and having a second end, with the second latch jaw being generally parallel to the first latch jaw; means for biasing the first and second latch jaws together; and wherein the actuator comprises, in combination: a camming surface for engaging with and separating the first and second latch jaws; and an abutting edge for resting on the first and second jaws after the camming surface passes through the first and second jaws.

16. The apparatus of claim 15 wherein the first lock member comprises, in combination: an extension attached to the track including an upstanding latch hook having an arcuate cam surface, wherein the second lock member comprises, in combination: a latch arm pivotally attached to the transfer carriage including a hook end having an arcuate cam end for camming upon the cam surface of the extension; and means for downwardly biasing the latch arm.

17. The apparatus of claim 16 wherein the second lock member moving means comprises an abutment end formed on the actuator, and wherein the abutment end, the camming surface, and the abutting edge forms a cone.

* * * * *